US005082259A

United States Patent [19]

Gonzalez

[11] Patent Number: 5,082,259

[45] Date of Patent: Jan. 21, 1992

[54] WEIGHT LIFTING APPARATUS

[76] Inventor: Karl Gonzalez, 1707 Bragdon, Pueblo, Colo. 81004

[21] Appl. No.: 577,553

[22] Filed: Sep. 5, 1990

[51] Int. Cl.[5] ..... A63B 21/78

[52] U.S. Cl. ..... 272/123; 272/144; 272/DIG. 4

[58] Field of Search ..... 272/117, 118, 123, 134, 272/144, DIG. 4

[56] References Cited

U.S. PATENT DOCUMENTS

| | | | |
|---|---|---|---|
| 4,290,597 | 9/1981 | Schleffendorf | 272/117 |
| 4,319,747 | 3/1982 | Rogers | 272/123 X |
| 4,369,966 | 1/1983 | Silberman et al. | 272/123 X |
| 4,382,596 | 5/1983 | Silberman | 272/123 X |
| 4,537,395 | 8/1985 | Spinelli | 272/123 |
| 4,635,934 | 1/1987 | Roethke | 272/123 X |
| 4,799,673 | 1/1989 | Selle | 272/123 |
| 4,861,024 | 8/1989 | Lee | 272/123 |
| 4,907,798 | 3/1990 | Burchatz | 272/123 X |
| 4,915,377 | 4/1990 | Malnke et al. | 272/118 |

OTHER PUBLICATIONS

"Strength and Health," Oct.-Nov. 1974, p. 63, advertisement for York All-in-One Gym.

*Primary Examiner*—Robert Bahr
*Assistant Examiner*—Linda C. M. Dvorak

[57] ABSTRACT

Disclosed is a weight lifting apparatus having a padded bench for supporting the weight lifter. This bench is designed to fold into a V-shape, having a seat portion and a back support portion, that allows the weight lifter to adjust the bench into a semi-sitting position for certain lifts. The bench is attached to a frame having slide supports at one end. The slide supports are located above the padded bench high enough to be above the body of an inclined weight lifter. An adjustable weight holder is connected to the slide supports using a pair of connecting tubes. The adjustable weight holder can be adjusted up or down to hold the weight being lifted at varying heights, and it can be adjusted through the slide supports to be positioned at various locations over the padded bench. The connecting tubes allow the weight holder to be adjusted while also providing a safety mechanism to catch the weight, should it be dropped, before the weight can contact the weight lifter. A pair of calf lift weight holders can be attached to the frame to support the weight at a proper height during calf lifts. A chest support mechanism is provided for attachment to the adjustable weight holder, to hold the bench in a near vertical position to assist the weight lifter in performing exercises with a weight in front the weight lifter's chest. A pectoral muscle exercise apparatus is also provided for attachment to the weight lifting apparatus. Additional attachments are provided for performing dip, leg curl, rows, latorial and arm curl exercises. A selectively attachable adjustable cable and pulley system allows adjustment of both the initial lift starting point and length of the lift in a variety of different exercises.

17 Claims, 13 Drawing Sheets

WEIGHT LIFTING APPARATUS

BACKGROUND OF THE INVENTION

This invention relates to a weight lifting apparatus and more particularly to a new and improved apparatus that allows the weight to be adjusted to many different positions over a weight lifter.

It is important for a participant in regular bench press exercise to work out at or near his limit, always attempting to perform more repetitions or adding more weights. It is also important for many different exercises to be performed in different positions.

In bench pressing, a padded bench, which may be horizontal or inclined, is positioned below a weight holding means. The weight holding means holds the weight bar and is lowered to a point slightly less than the outstretched grasp of the weight lifter lying on his back on the bench. To exercise, the lifter grasps the bar, lifts it off the holding means and then raises and lowers it over his chest. This causes an obvious problem when the lifter becomes exhausted—the danger that the lifter will drop the weight onto his chest.

Several prior art devices, for example see U.S. Pat. No. 4,635,930 by Cormier, U.S. Pat. No. 4,411,425 by Milnar, and U.S. Pat. No. 4,231,570 to Reis provide some safety when the weight lifter is performing a basic lift. They do not, however, provide safety when many other different type of lifts, for example lifts in a sitting position, are being performed.

Prior art devices support the weight in only one location above the weight lifter, thus making it more difficult to perform lifts other than the basic lift, where the lifter is lying on his back. For example prior art devices do not support the weight in a position that allows calf lifts. Prior art devices also limit the exercise to lifting weights, and do not provide the ability to perform other exercises, such as chin-ups.

Prior art devices allow part of the padded bench of the apparatus to be inclined upward to allow some exercises from a sitting position. These devices, however, do not incline the seat portion of the padded bench, thus the lifter must also keep from sliding off the bench while performing the exercise. This takes some of the lifter's attention away from the exercise, thus increasing the risk of dropping the weight.

It is thus apparent that there is a need in the art for an improved method or apparatus which allows the weight to be supported over the lifter in various positions, while still providing a safety mechanism to support the weight in the event that it is dropped. There is also a need in the art for an apparatus that will assist the lifter in performing other types of lifts, such as calf lifts, rows, leg curls and other exercises, such as chin-ups. There is a further need in the art for such an apparatus that allows the padded bench to be inclined to provide both an inclined seat and an inclined back support.

SUMMARY OF THE INVENTION

It is an object of the present invention to provide an apparatus for assisting in the lifting of weights.

It is another object of the invention to provide such an apparatus that provides a weight holding means that is adjustable to a plurality of positions over a bench of the apparatus.

It is still another object of the invention to provide such an apparatus wherein the weight holding means also provides a pair of safety tubes that will prevent the weight from contacting the weight lifter in the event the weight is dropped.

It is another object to provide such an apparatus wherein the weight holding means can be extended away from the padded bench to allow the weight lifter to perform other exercises using the weight holding means alone.

It is another object to provide such an apparatus wherein the bench bends at a point to provide a V-shaped sitting arrangement with an inclined seat portion.

It is a further object to provide such an apparatus that provides a calf lift weight holding means that supports the weight during calf lifts.

It is a further object to provide such an apparatus that provides a bar pad means that provides padding between the weight lifter's legs and the weight bar during calf lifts.

It is a further object to provide such an apparatus that provides an adjustable upper chest support that provides padding to the weight lifter's chest during lifts in front of the weight lifter.

It is a still further object to provide such an apparatus that includes a Pec Deck Flyes apparatus that attaches to the weight lifting apparatus to allow a weight lifter to perform pectoral muscle exercises.

It is a still further object to provide such an apparatus that includes a dip bar apparatus that attaches to the weight lifting apparatus to allow a weight lifter to exercise the arms and chest.

A still further object of the present invention is to provide a series of pulleys used with the weight lifting apparatus to allow a weight lifter to exercise the legs and back.

The above and other objects of the present invention are accomplished in a weight lifting apparatus having a padded bench for supporting the weight lifter. This bench is designed to fold into a "V" shape, having a seat portion and a back support portion, that allows the weight lifter to adjust the bench into a semi-sitting position for certain lifts. The bench is attached to a frame having slide supports at one end. The slide supports are located above the padded bench high enough to be above the body of a reclined weight lifter. An adjustable weight holder is connected to the slide supports using a pair of connecting tubes. The adjustable weight holder can be adjusted up or down to hold the weight being lifted at varying heights, and it can be adjusted by movement of the connecting tubes through the slide supports to be positioned at various locations over the padded bench. The connecting tubes allow the weight holder to be adjusted while also providing a safety mechanism to catch the weight, should it be dropped, before the weight can contact the weight lifter.

A knee pad is connected to the frame underneath the padded bench to provide lower leg support when the weight lifter is seated on the bench. It can also be moved to a different position on the frame to support the back support portion of the padded bench when such padded bench is adjusted into a sitting position.

A pair of calf lift weight holders can be attached to the frame to support the weight at a proper height during calf lifts. A pad can also be attached to the weight during calf lifts to provide padding between the weight lift bar and the weight lifter's upper leg.

The bench is also provided with an adjustable support to allow the bench to be placed in a vertical or near vertical position to support the chest of the weight lifter performing lifts in front of the weight lifter. In addition, pectoral muscle exercise apparatus can be attached to the adjustable weight holder. This apparatus hangs down over a weight lifter seated on the bench, to allow the weight lifter to exercise the pectoral muscles while in a sitting position. A dip bar apparatus is provided for attachment to the adjustable weight holder to allow the weight lifter to exercise the arms and chest over the end of the apparatus. Also, an apparatus including a cable and a series of pulleys is provided for attachment to the frame and the adjustable weight holder to allow the weight lifter to exercise the back while sitting in front of the apparatus, and to allow the weight lifter to exercise the legs while sitting on the edge of the apparatus. The selectively attachable adjustable cable and pulley system allows adjustment of both the initial lift starting point and length of the lift in a variety of different exercises.

BRIEF DESCRIPTION OF THE DRAWINGS

The above and other objects, features, and advantages of the invention will be better understood by reading the following more particular description of the invention, presented in conjunction with the following drawings, wherein.

DESCRIPTION OF THE PREFERRED EMBODIMENT

The following description is of the best presently contemplated mode of carrying out the present invention. This description is not to be taker in a limiting sense but is made merely for the purpose of describing the general principles of the invention. The scope of the invention should be determined by referencing the appended claims.

Figure 1A:
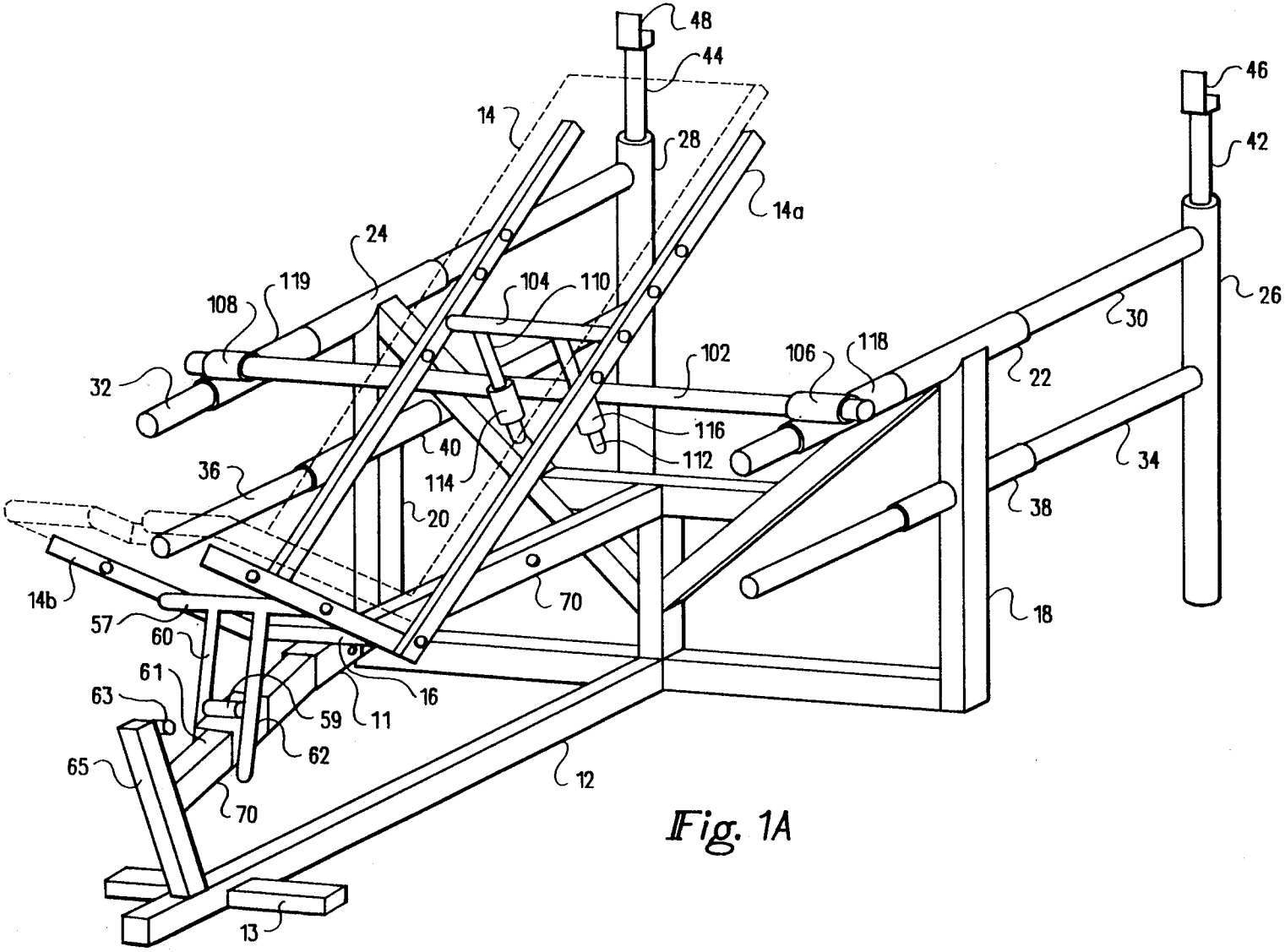
FIG. 1A shows a perspective view of the weight lifting apparatus.

FIG. 1A shows a perspective view of the weight lifting apparatus. Referring now to FIG. 1A, weight lifting apparatus 10 is shown having a frame 12 having a transverse stabilizing member 13. Attached to the frame 12 is a padded bench 14 having a hinge 16 that allows the bench 14 to fold into a V-shape. The frame 12 has two vertical members 18 and 20 that provide support for two fixed tubular slide supports 22 and 24, which are located above the bench, and located high enough that a weight lifter, lying horizontally on the bench 14, would be completely below the level of the slide supports 22 and 24.

A weight holding apparatus includes two vertical supports 26 and 28 perpendicularly secured to connecting tubes 30 and 32, which are slidably received within the slide supports 22 and 24. For stability, a second pair of tubes 34 and 36 are received within a second pair of slide supports 38 and 40 also mounted on the vertical members 18, 20, in spaced parallel relation with slide supports 22 and 24. Received within the vertical supports 26 and 28 are slidable weight supports 42 and 44, with bar holders 46 and 48 attached to the top of the slidable weight supports 42 and 44 respectively. The slidable weight supports 42 and 44 can be adjusted vertically by means of conventional set screws or locking pins (not shown) to position a weight bar, which is placed in the bar holders 46 and 48, at the desired height for each particular exercise.

The weight holding apparatus can be adjusted laterally by moving the vertical supports 26 and 28 to allow the tubes 30, 32, 34, and 36 to slide in or out of the slide supports 22, 24, 38, and 40. By sliding the vertical supports 26 and 28 laterally, the bar holders 46 and 48 can be moved to any desired position with respect to the bench 14. For example, the vertical supports 26 and 28 can be moved away from the bench to allow chin-up exercises to be performed from a bar resting on the bar holders 46 and 48.

Figure 1B:
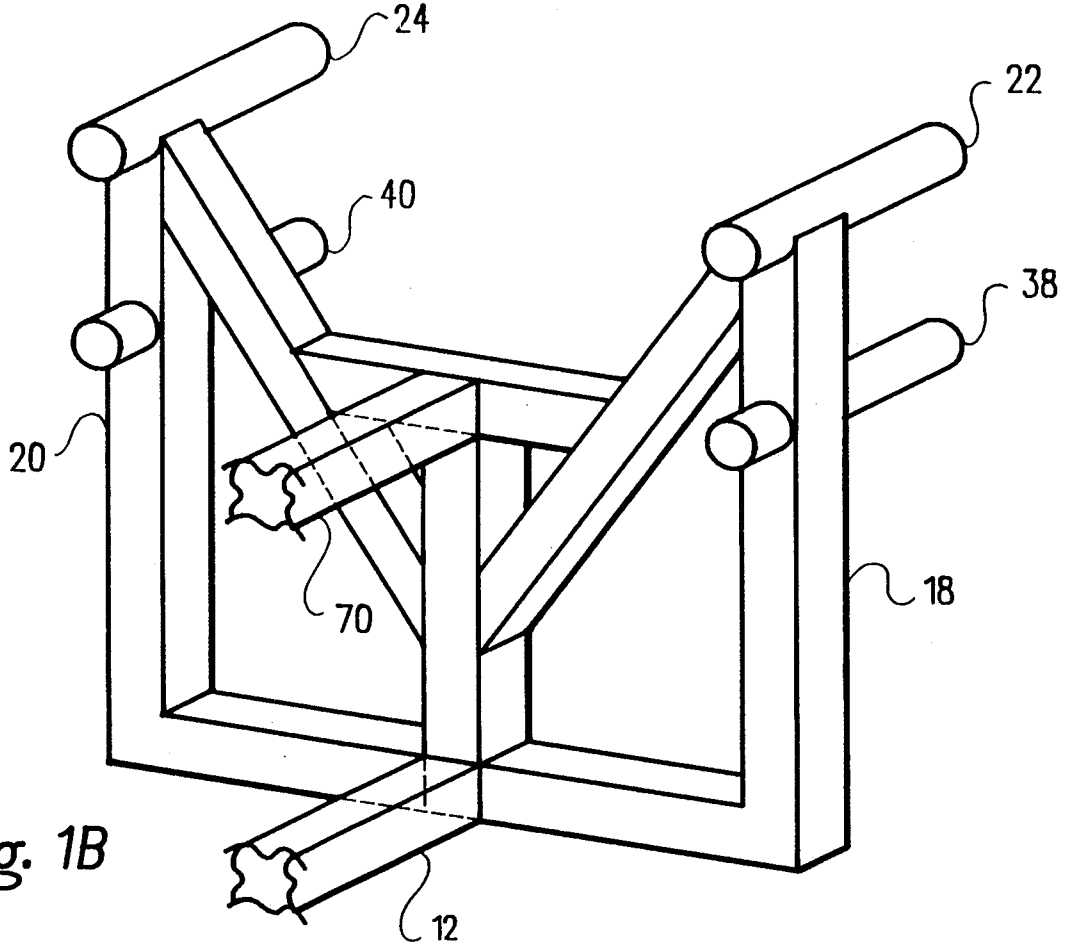
FIG. 1B shows a detail of the cross piece of FIG. 1A.

FIG. 1B shows a detailed perspective view of the vertical members 18 and 20 and the slide supports 22, 24, 38, and 40. FIG. 1B illustrates that the slide supports 22, 24, 38, and 40 are mounted inside the vertical members 18 and 20, however, those skilled in the art will recognize that the slide supports 22, 24, 38, and 40 could also be mounted to the outsides of the vertical members 18 and 20 without departing from the spirit and scope of the present invention.

Figure 2:
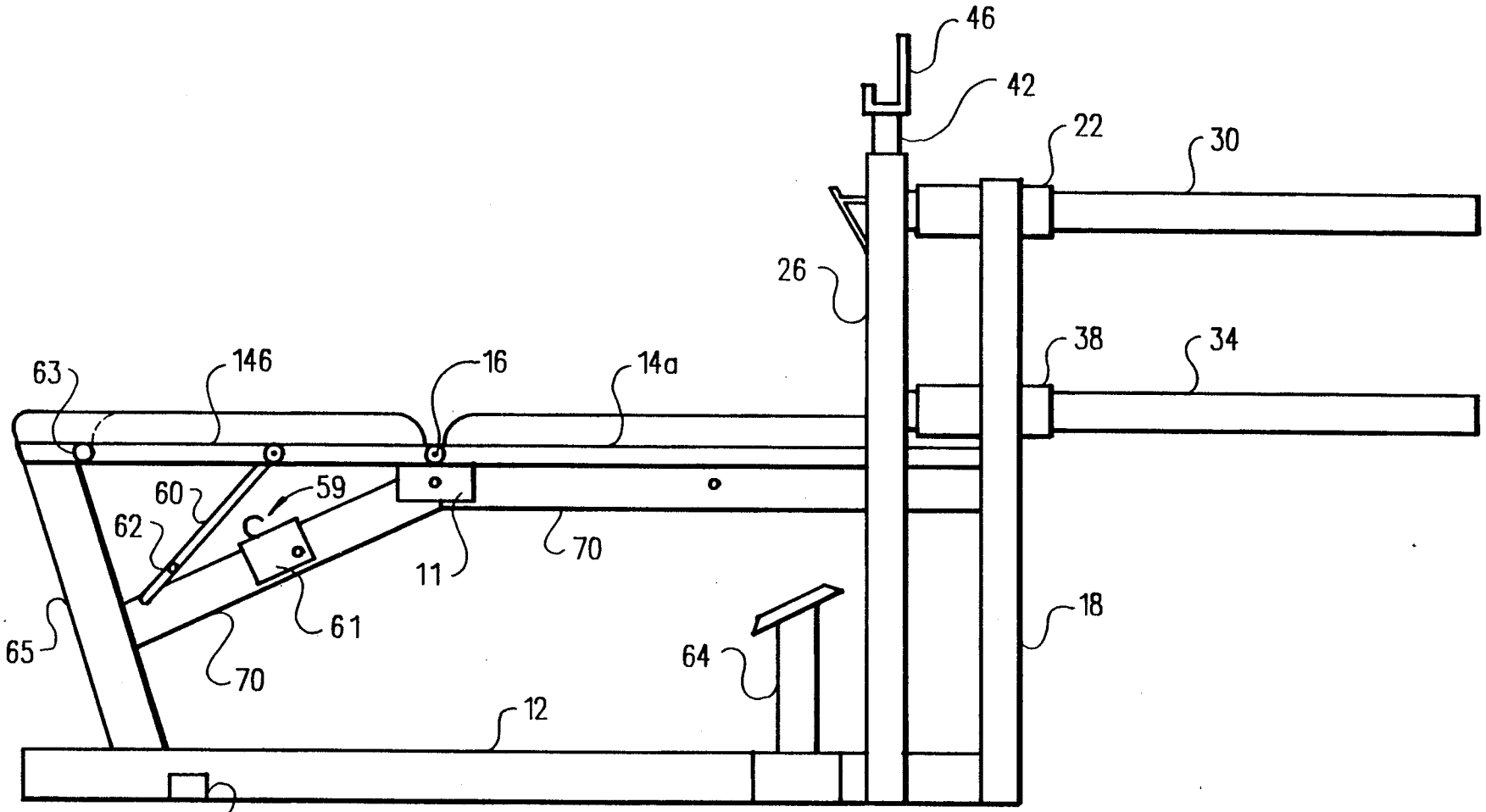
FIG. 2 is a side view of the apparatus showing the knee pad used for certain lifts.

FIG. 1A depicts the bench folded in a "V"-shaped configuration. The bench comprises a back portion 14A and a seat portion 14B pivotally connected by means of hinge 16. The hinge in turn is secured to a selectively translatable C clamp 11 for adjustable securement along a bar 70. The C clamp may be selectively secured at a particular position along the bar 70 by means of set screws or by means of locking pins which extend through the C clamp and the associated bar 70. As best shown in FIG. 2, the bar 70 is generally horizontal, but declines downwardly in the region disposed adjacent to the support bar 65.

The seat portion 14B of the bench is supported by an H-shaped support 60 fixedly connected to the seat portion 14B approximately midway along its length. The H-shaped support 60 is provided with a horizontal bar 62 adapted to selectively fit into a groove formed by an arcuate tab 59 fixedly attached to an associated C-clamp 61 also mounted on the bar 70. The H-shaped support 60 is connected to a cross-piece 57 that is adapted to be selectively attached at any selected one of a plurality of locations along the length of the seat portion 14B so as to be able to selectively adjust the angle of inclination of the seat portion 14B. The back portion 14A of the bench is inclined with respect to the horizontal by means of a support rod 102 horizontally extending above and across the tubes 30, 32. The support rod 102 is adapted to extend through a pair of rings 106, 108 that are fixedly mounted on an associated pair of rings 118, 119 through which an associated one of the tubes 30, 32 extends. Another pair of rings 111, 114 are mounted approximately midway along the support rod 102 and are adapted to receive an associated one of a pair of prongs 110, 112, extending downwardly from a cross-piece 104. The cross-piece 104 is adapted to be mounted at any one of a plurality of locations along the back portion 14A of the bench so that the angle of inclination of the back portion 14A may be selectively adjusted.

With reference to FIGS. 1 and 2, the bench may be made completely horizontal by disengaging the horizontal bar 62 from its seat within the groove of the tab 59 of the C clamp 61, and by removing the support rod 102 from within the rings 106 and 108. In this position, the seat portion 14B of the bench is prevented from declining by means of its resting on a support piece 63 mounted on the support bar 65.

Also as shown in FIG. 2, the vertical supports 26 and 28 may be rearranged on the opposite sides of the two vertical members 18, 20, by reversing the direction of insertion of rods 30, 32, 34, 36 through their respective slide support tubes 22, 24, 38, 40.

FIG. 2 also illustrates a shin pad 64 which is selectively attachable to the frame 12. The pad 64 can be placed in the position shown when the weight lifter desires to sit on the end of the bench nearest the frame member 20 to lift weights over the end of the bench 14.

Figures 3, 3A:
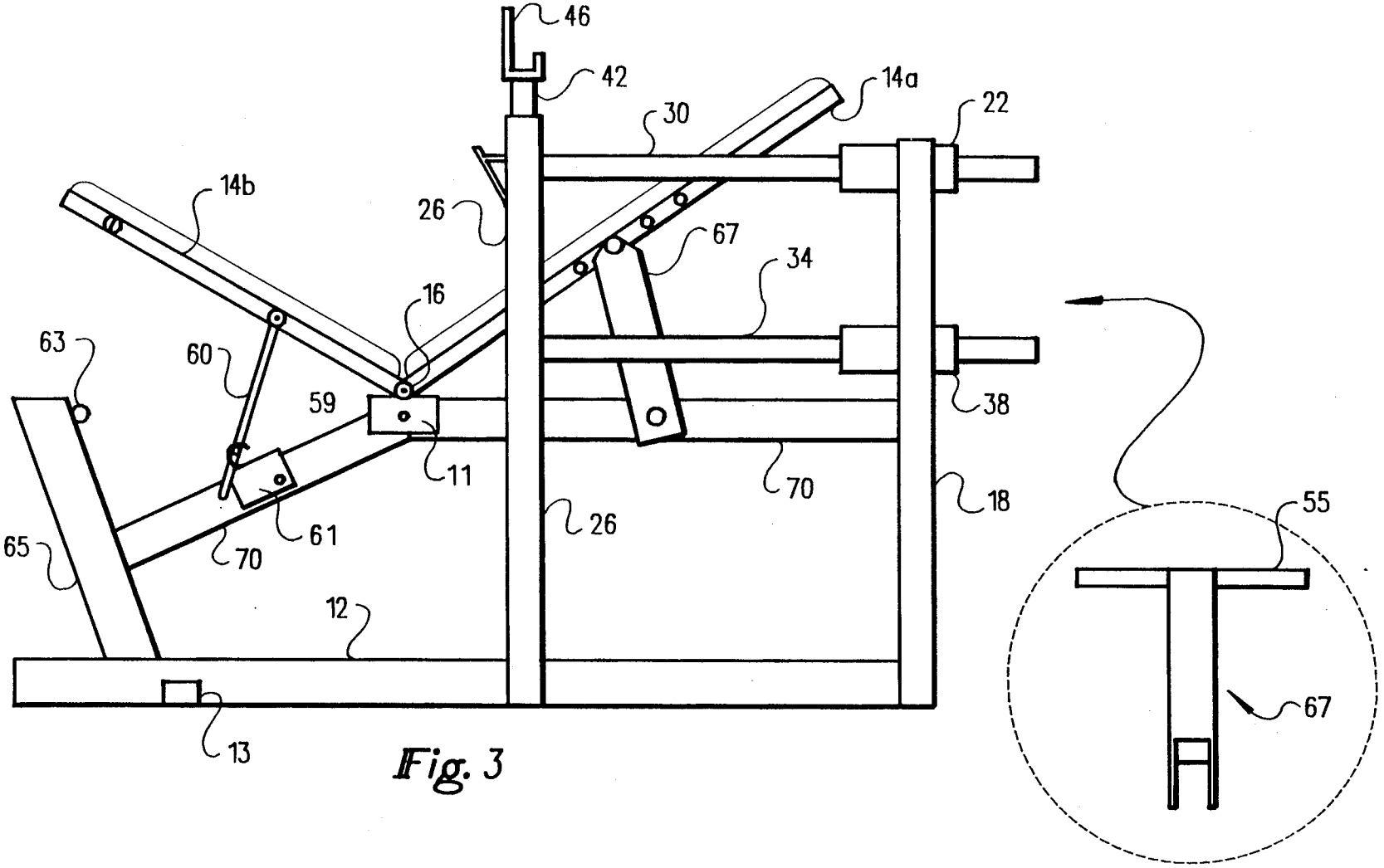
FIG. 3 is a side view showing the adjustable weight holder positioned over the bench, which is folded into a V-shape.
FIG. 3A shows an isolated front view detail of a shin that helps support the bench.

As shown in FIG. 3, the back portion 14A of the bench may be inclined relative to the bar 70, but at an angle less than the angle of inclination shown in FIG. 1A. In FIG. 3, a shin 67 having a cross-member 55 (FIG. 3A) is utilized in place of the support rod 102, cross-piece 104, prongs 110, 112 and rings 106, 108, 111, 114, 118 and 119 shown in FIG. 1A. The cross-member 55 is adapted to be selectively attached to any one of several positions along the back portion 14A of the bench, in place of the cross-piece 104 shown in FIG. 1A. The opposite end of the shin 64 is adapted to be selectively, fixedly mounted on the bar 70 by means of a C clamp, or the like.

With the apparatus adjusted as shown in FIG. 3, the weight lifter can sit on the bench 14 with the weight, held by the bar holders 46 and 48, placed in front of him. In this position, the weight lifter can lift the weight, and should the weight drop, it will be stopped by the tubes 30 and 32 before it contacts the weight lifter. This safety feature is present with the bench in the folded position shown in FIG. 3, as well as the unfolded position as was illustrated in FIG. 2.

Figure 4A:
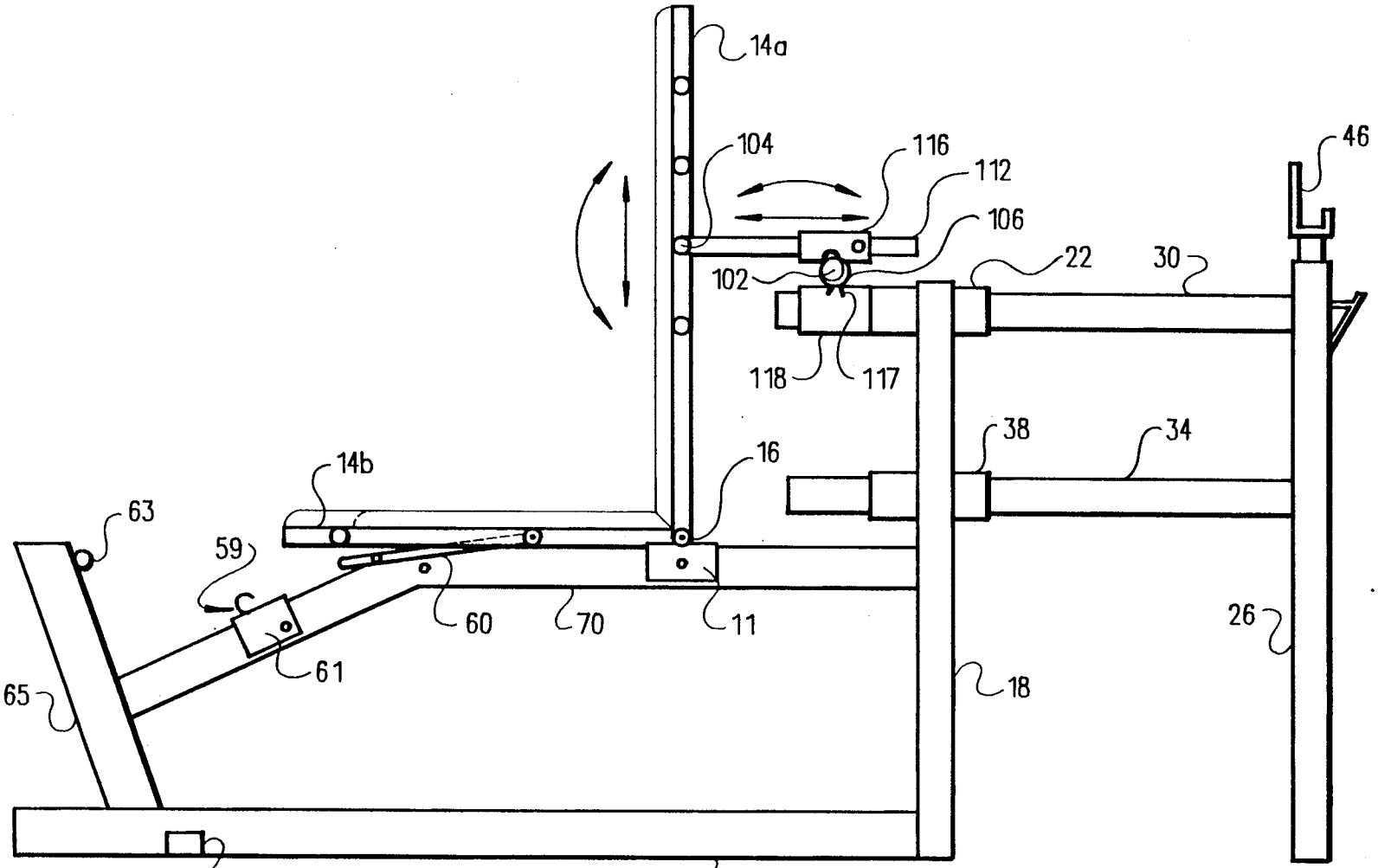
FIG. 4A is a side view of the apparatus showing the bench folded in a vertical orientation for exercises needing chest support.
Figure 4B:
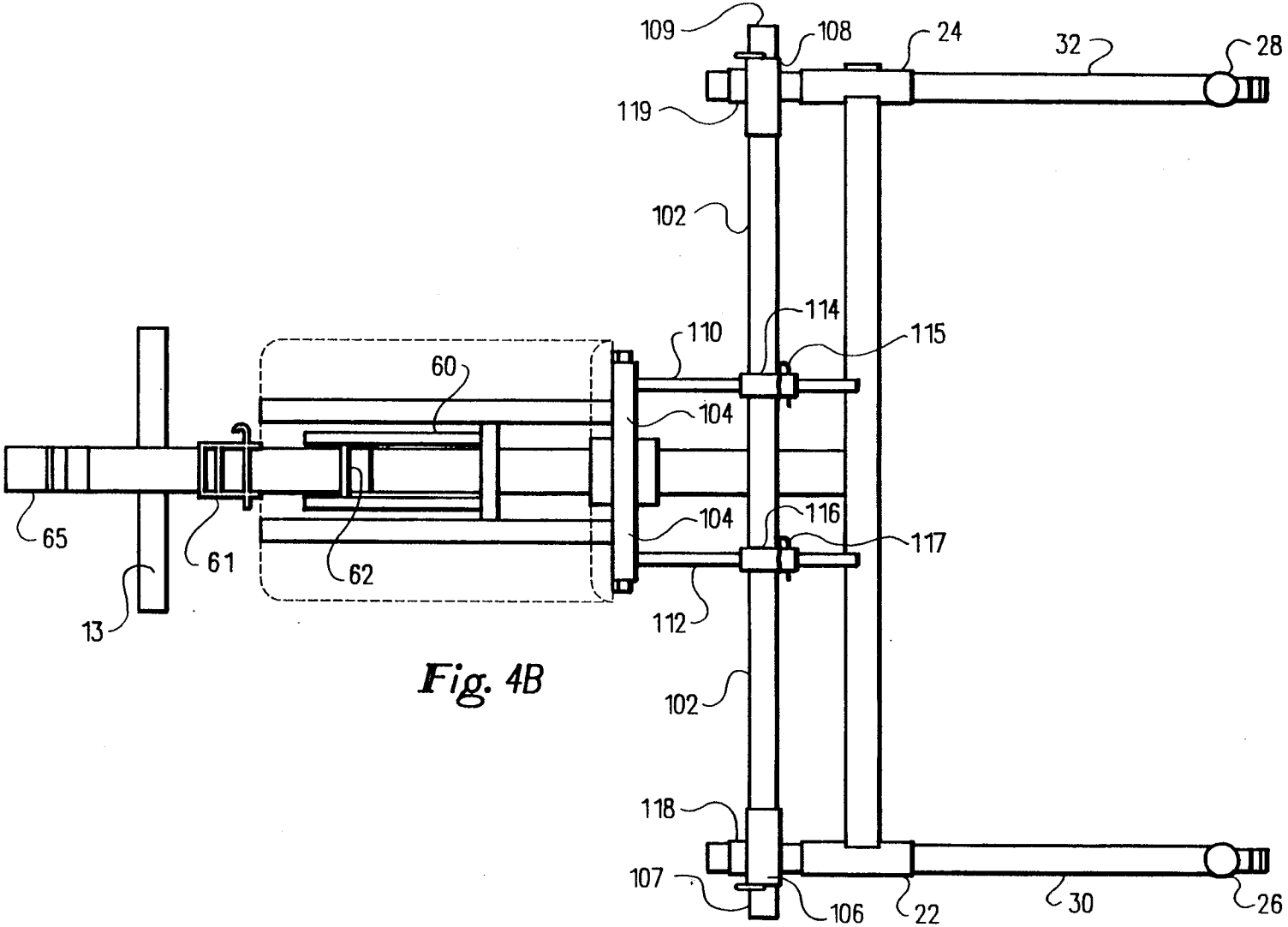
FIG. 4B is a top view of the apparatus in the mode shown in FIG. 4A.

FIGS, 4A and 4B show the upper chest support system which allows the bench back portion 14A to be placed in a vertical or near vertical position for exercises where the weight lifter's chest or back must be supported. The apparatus shown in FIG. 1A may be readily modified in order to place the seat portion 14B of the bench in a horizontal position and the back portion 14A of the bench in a vertical position, as shown in FIGS. 4A and 4B. Such modification is made by changing the selected, fixed location on the bar 70 of the C clamp 11 upon which the hinge 16 is mounted. The back portion 14A of the bench is prevented from wobbling by means of cotter pins 115, 117 extending through the rings 114, 116 and concurrently through the prongs 110, 112, as best shown in FIG. 4B. Also as shown in FIG. 4B, the support rod 102 may be selectively prevented from translating within the rings 106, 108 by means of locking pins 107, 109 extending through the ends of the support rod 102. Furthermore, the rings 118, 119 through which the tubes 30, 32, respectively, extend, may be selectively prevented from translating along the tubes 30, 32 by means of conventional set screws or locking pins (not shown).

Figures 5A, 5B:
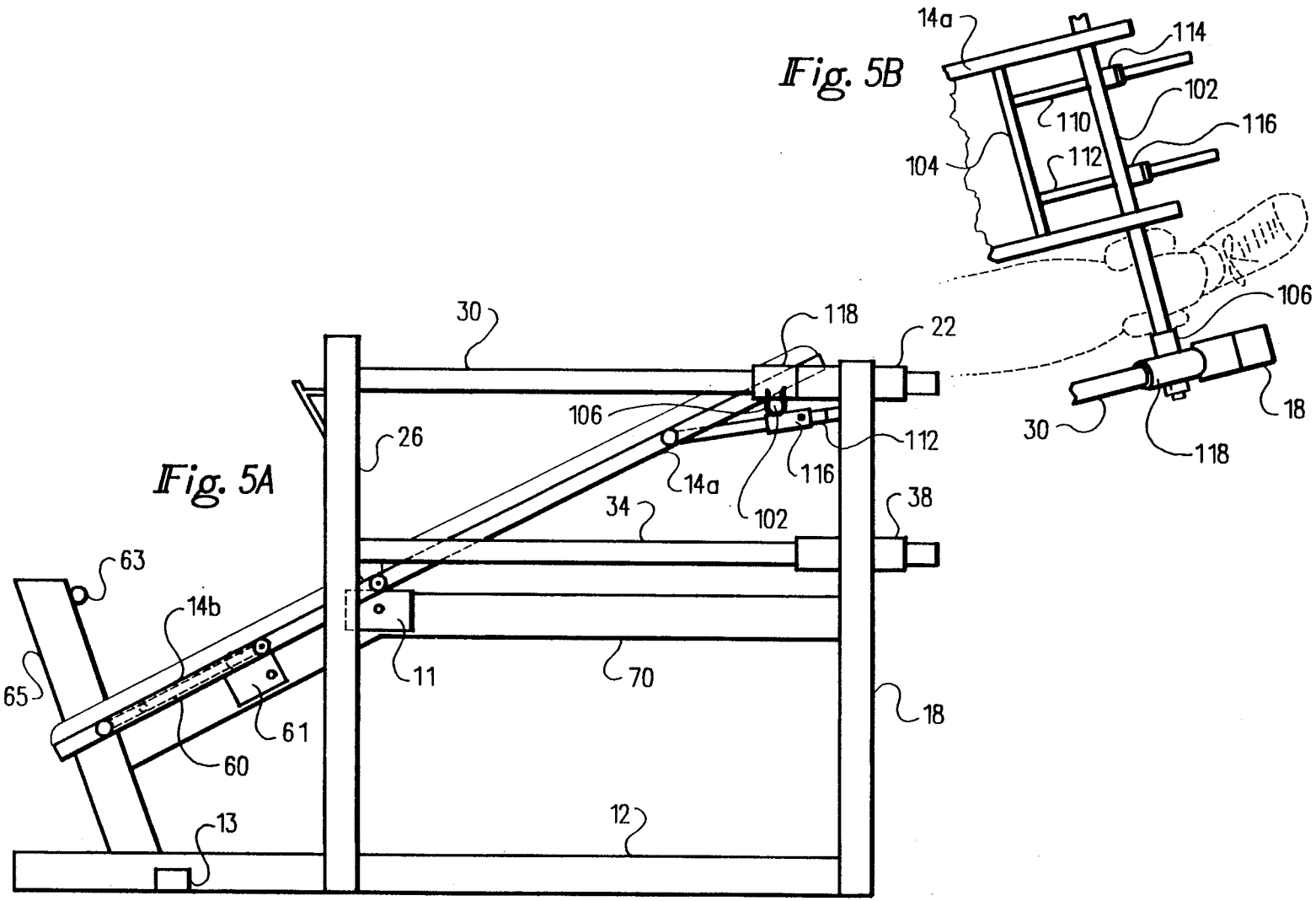
FIG. 5A is a side view of the apparatus with an alternative back support position.
FIG. 5B is a partial end view of the alternative back support shown in FIG. 5A depicting how the user's feet are placed on the apparatus.

FIGS. 5A and 5B show how the apparatus shown in FIGS. 1A and 4A can be further manipulated so as to make both portions 14A, 14B of the bench co-planar along the line of declination of the declined portion of the bar 70. In this mode of the apparatus, the weight lifter hooks his heels over the support rod 102, as best shown in FIG. 5B, with his head and shoulders over the seat portion 14B. The weight lifter then uses his arms to lift the weights suspended from the vertical supports 26, 28. Such exercises are known as the decline press lifts.

The various sliding and rotating mechanisms allow the bench 14 to be placed in various vertical positions to provide great flexibility for the weight lifter.

Figure 6B:
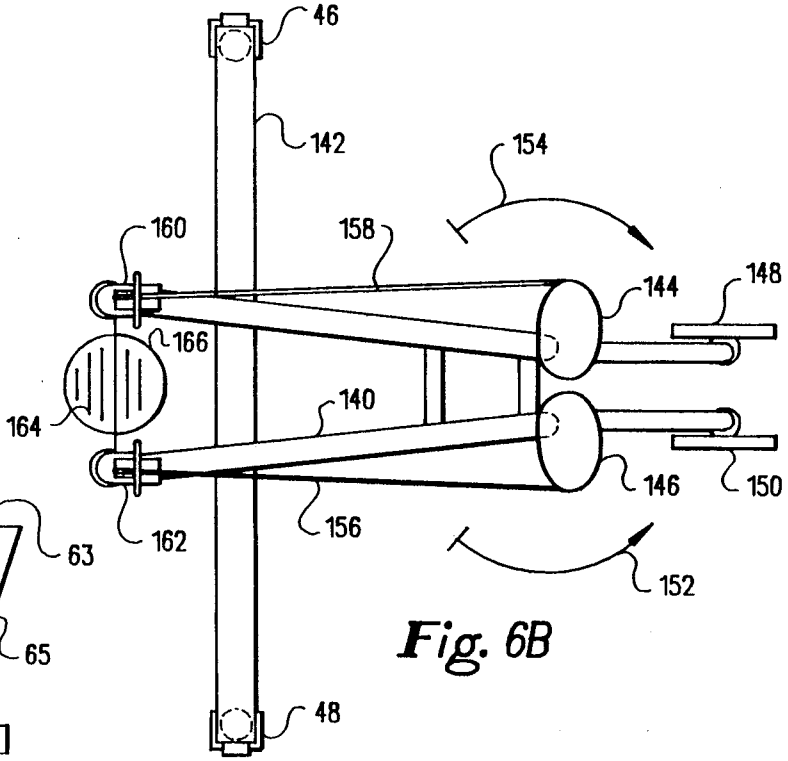
FIG. 6B is a top view of the Pec Deck Flyes apparatus.
Figure 6A:
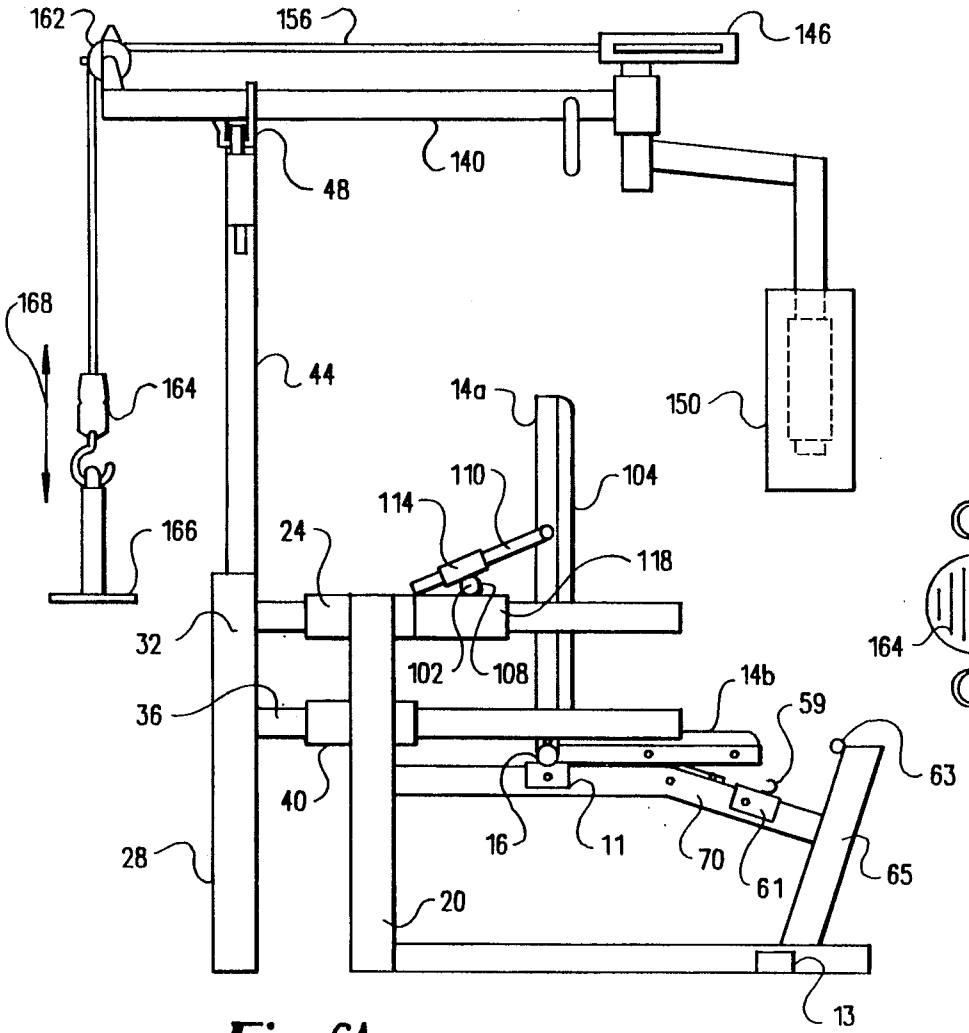
FIG. 6A is a side view of a Pec Deck Flyes apparatus.

FIG. 6A and 6B show the Pec Deck Flyes apparatus which allows a weight lifter to exercise the pectoral muscles. Referring now to FIGS. 6A and 6B, the Pec Deck Flyes apparatus attaches to the top of the weight holders 46 and 48 (FIG. 1), and is rigidly attached when being used. A horizontal bar 142 extends between and removably attaches to the weight holders 46 and 48 at each end of the horizontal bar 142 through means of cotter pins or other suitable fasteners. A support member 140 extends out over the weight lifter and supports a pair of egg-shaped cam lifters 144 and 146 which rotate in the directions of arrows 154 and 152, respectively, when the weight lifter pushes the pads 148 and 150 together. Also attached to the egg-shaped cam lifters 144 and 146 are opposite ends 158 and 156 of a single cable which extends rearwardly from the egg-shaped cam lifters 144 and 146 over a pair of pulleys 160 and 162 and down around a weight pulley 164 to lift an attached weight disk 166. Rotation of the pads 148 and 150 thus causes the weight disk 166 to move in the direction of arrow 168. The weight lifter can thus change the force necessary to rotate the pads 148 and 150 by changing the amount of weight on the weight disk 166.

Figure 7B:
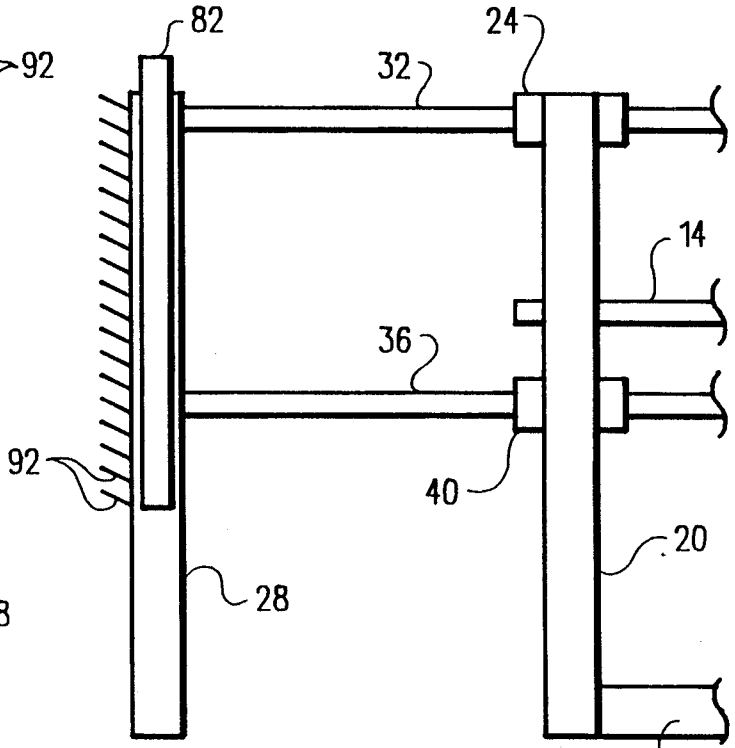
FIG. 7B is a side view of the calf lift weight holders shown in FIG. 7A.
Figure 7A:
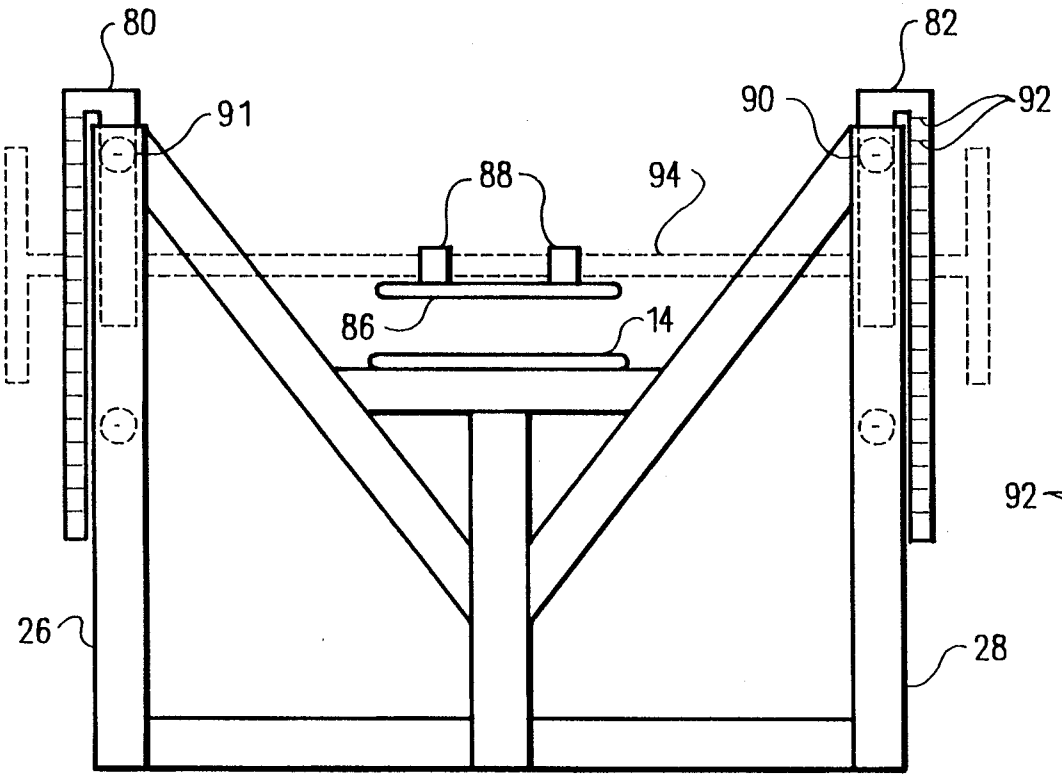
FIG. 7A is an end view of the apparatus showing calf lift weight holders.

FIG. 7A shows an end view of the weight lifting apparatus and illustrates the calf lifting apparatus attached thereto. Referring now to FIGS. 7A, B, and C, a pair of slidable calf lifting supports 80 and 82 are shown inserted into the top of vertical supports 26 and 28 respectively and held in place by integral sliding insert portions 90 and 91 which are received inside the supports 26 and 28. A weight bar, illustrated by dotted lines 84, is shown being supported by the calf lifting supports 80 and 82. A pad 86 is shown attached to the weight bar 84 by means of a pair of clamps 88. This pad cushions the weight lifter's legs, which are placed under the weight bar 84 when the weight lifter is performing calf exercises.

FIG. 7B shows a side view of the calf lifting apparatus. Referring now to FIG. 7B, the calf lifting support 82 is shown attached to vertical support 28 by means of the sliding insert 90 (FIG. 4A) which is placed inside the support 28 and allowed to slide up and down as the weight lifter performs the exercise. Also shown are a series of hooks 92 which are attached to the calf lifting supports at various locations to allow the weight lifter to place the weight bar (not shown in FIG. 7B) at any desirable height.

Figure 7C:
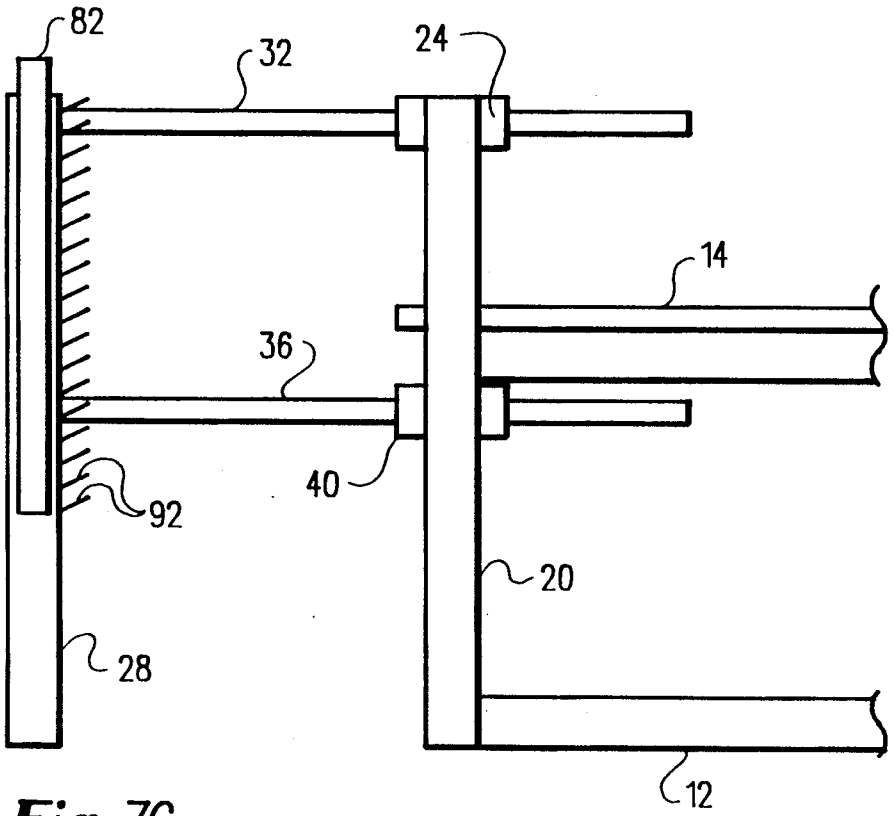
FIG. 7C is a side view showing the calf lift weight holder in an alternative position.

FIG. 7C shows another side view of the calf lifting apparatus. Referring now to FIG. 7C, the calf lifting support 82 is shown slidably connected to the vertical support 28 and is shown with the hooks facing in a rearward direction as compared to FIG. 7B so that the weight bar can also be placed on the opposite side of the vertical support 28.

Figure 8:
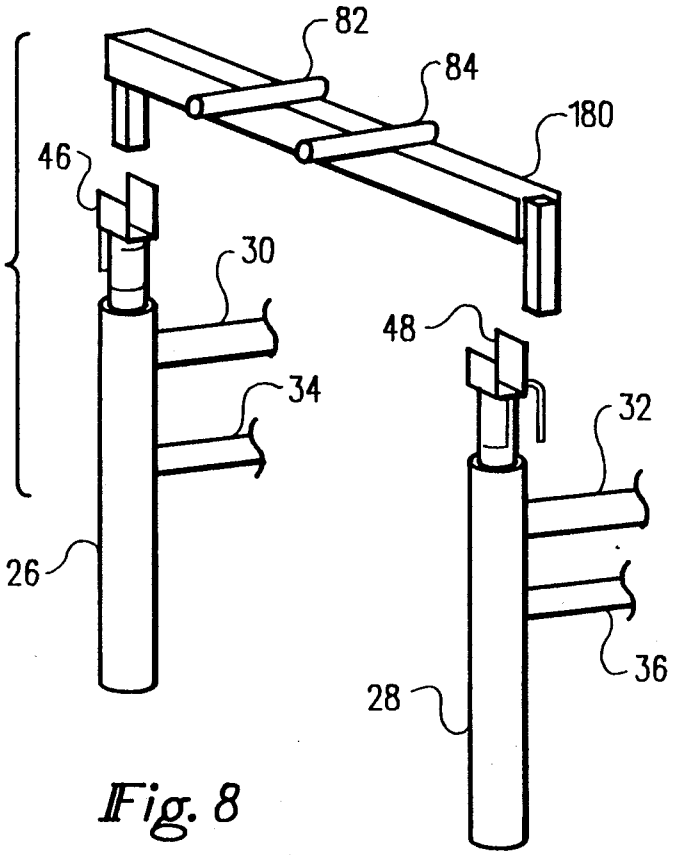
FIG. 8 is a perspective view of a dip bar attachment used with the system.

FIG. 8 shows a dip bar mechanism used with the weight lifting system. Referring now to FIG. 8, a horizontal bar 180 is attached to the weight holders 46 and 48 at each end, by suitable fasteners. Attached to the horizontal bar 180 are a pair of handles 182 and 184 used by the weight lifter to exercise the arms and chest through performance of conventional dip exercises.

Figures 9, 9A, 9B:
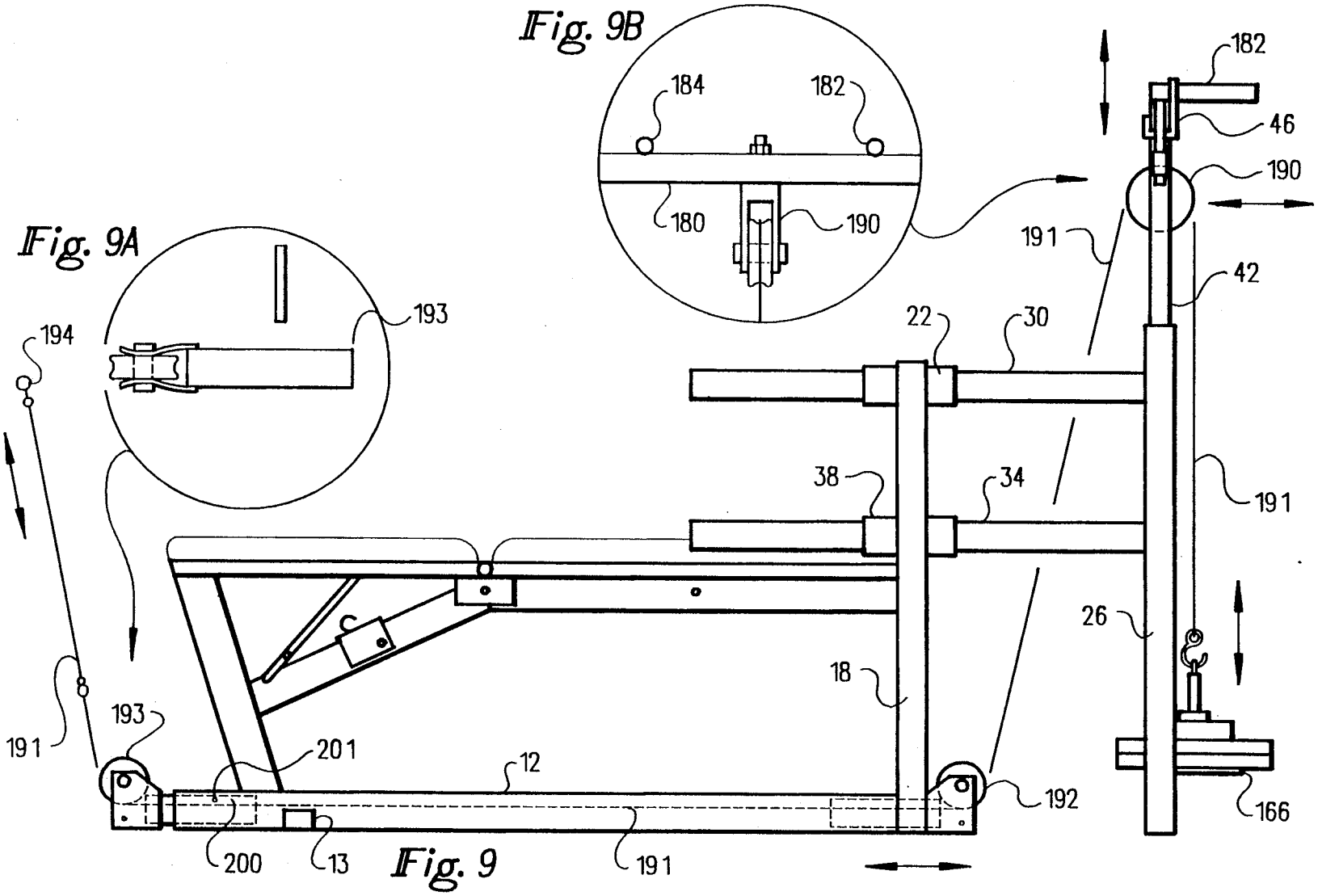
FIG. 9 is a side view showing a pulley attachment mounted on the weight lifting apparatus.
FIG. 9A is an isolated top detail view of the front pulley attachment.
FIG. 9B is an isolated front detail view of the upper pulley attached to the dip bar attachment.

FIGS. 9, 9A and 9B show pulley attachments which allow a weight lifter to exercise the arms, legs and back. An upper support pulley 190 is attached to the dip bar mechanism horizontal bar 180. A cable 191 runs over the pulley 190 and extends downwardly around a lower rear pulley 192 which is secured to the lower rear portion of the frame 12. The cable 191 passes around the pulley 192 and extends forwardly through the frame 12, under an adjustable front pulley 193. The rear 192 and front 193 pulley attachments each include a hollow rectangular stem portion 200 insertable into the open ends of the hollow tubular frame 12. The pulley attachment stems may be retained in a selected position by transverse retaining pins 201 extending through the stems and through the frame 12. A weight lifter positioned in front of the weight lifting apparatus may accomplish a number of lifts by using a handle 194 attached to the cable 191.

Figure 10:
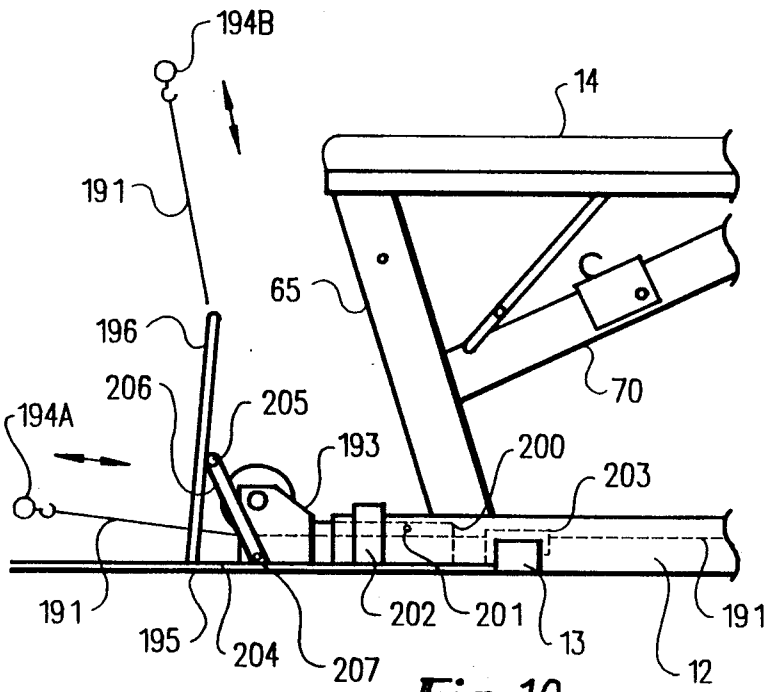
FIG. 10 is a side view of the front pulley attachment, showing the front frame retainer attachment.

As shown in FIG. 10, a retainer attachment includes a horizontal plate 195 having an upstanding abutment member 202. The abutment member 202 has a rectangular aperture through which the stem 200 of the pulley 193 extends, into the frame 12. The abutment member 202 is thus captured between the pulley 193 and the frame 12, upon insertion of the retaining pin 201. An end portion of the plate 195 is provided with a rectangular channel-shaped flange 203 dimensioned for engagement around the transverse frame stabilizer 13. A pivotally adjustable support plate 196 is secured to the plate 195 by a hinge 204. A support strut 206 is pivotally attached at 205 to a back surface of the plate 196. An opposite end 207 of the strut 206 is selectively adjustable along a slot or series of spaced apertures formed in the upper surface of the plate 195. Through this arrangement, the plate 196 may be secured in any desired angular position with respect to the plate 195. A weight lifter standing on the plate 195 may lift the handle attached to the cable 191 to the position shown at 194B to perform .standing arm curls or standing rows. The weight lifter may perform seated rows by sitting on the floor facing the weight lifting apparatus, with his feet in abutment with the vertical plate 196, and with the cable handle disposed in the position shown at 194A.

Figure 11:
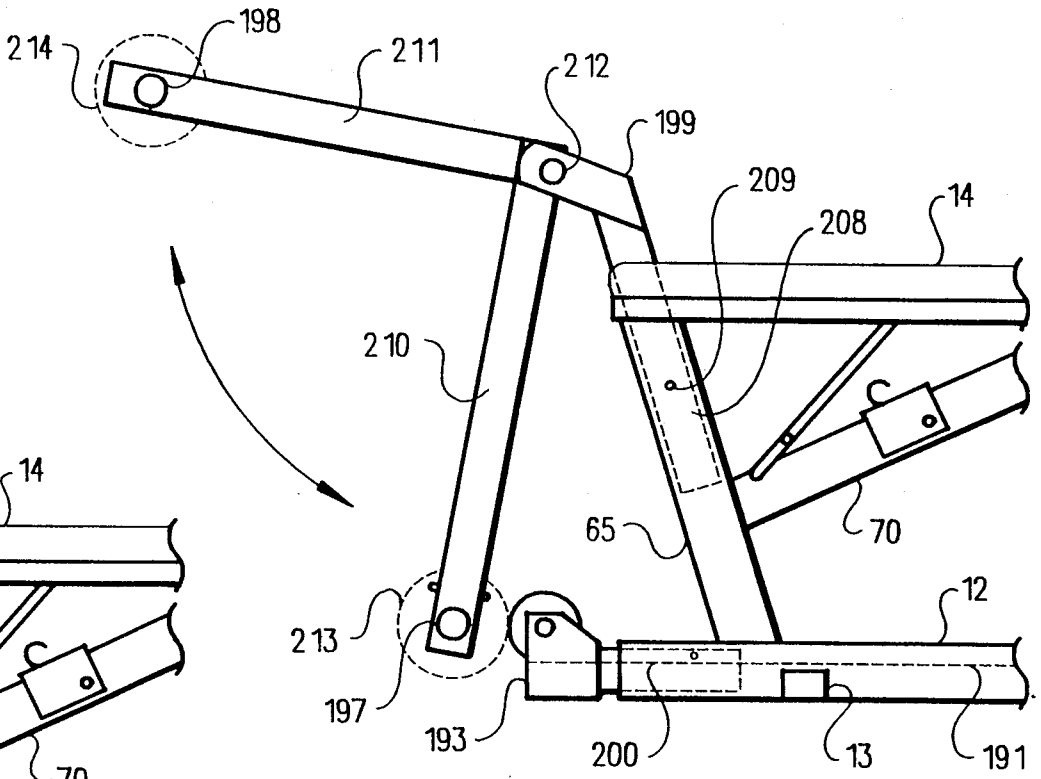
FIG. 11 is a side view of the front pulley attachment mounted on the frame for use in conjunction with a leg lifting attachment.

FIG. 11 illustrates a leg exercise attachment for the weight lifting apparatus which includes a rectangular stem 208 inserted within the upper open end of the support bar 65 and secured by transverse retaining pin 209. An obliquely angled support arm 199 extends rearwardly from the stem 208 and provides a rotational mounting for an axle 212. Lower 210 and upper 211 lifting bars are secured in perpendicular relation for rotation with the axle 212. Cylindrical support pads 213 and 214 are secured by rods 198 and 197 on the lifting bars 210 and 211. The cable 191 is secured to the free end of the bar 210. By sitting on the padded bench 14 with the legs extending over the edge of the bench and under the pad 213 of the lower lifting bar 210, a weight lifter may perform leg extensions to exercise the quadrilateral muscles of the legs. By lying face down on the bench 14 with the legs extending under the pad 214 of the upper lifting bar 211, a weight lifter may perform leg curl exercises.

Figure 12:
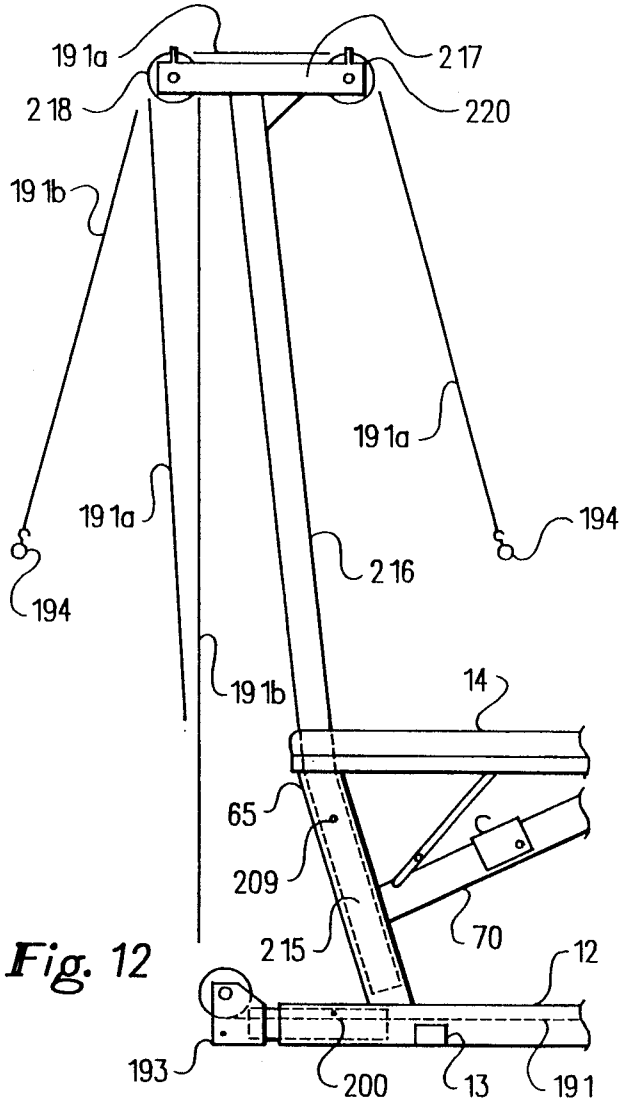
FIG. 12 is a side view of the front pulley attachment mounted on the frame in conjunction with a vertical pulley attachment for use in exercising latorial muscles.

A vertical pulley support attachment for use in exercising the latorial muscles of the back is shown in FIG. 12. A rectangular stem 215 is inserted into the hollow rectangular support bar 65 and secured by transverse retaining pin 209. A vertical support post 216 extends upwardly from the stem 215 and terminates in a transverse pulley support arm 217. A pair of pulleys 218 and 220 are mounted at opposite ends of the arm 217. By passing the cable 191 around the pulleys 218 and 220 in the orientation shown at 191A, a weight lifter may sit on the bench 14 and pull the handle 194 downwardly to exercise the arms and upper body. By passing the cable 191 around the pulley 218 in the orientation shown at 191B, a weight lifter may stand in front of and facing the post 216 to pull the handle 194 downwardly to perform arm and upper body exercises such as tricep extensions.

Figure 13:
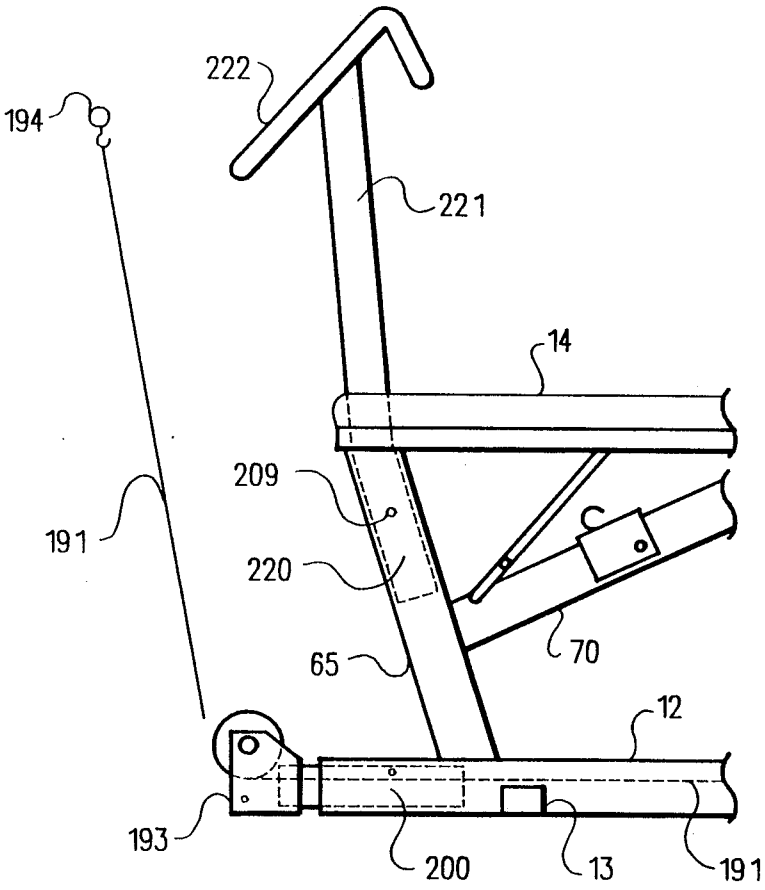
FIG. 13 is a side view of the front pulley attachment mounted on the frame in conjunction with an arm curl attachment.

An arm curl attachment may also be selectively secured to the weight lifting apparatus, as shown in FIG. 13. A rectangular stem 220 extends downwardly at a slight angle relative to post 221, and into the support bar 65. Retaining pin 209 prevents displacement of the stem 220. An inclined padded support 222 is secured to the top of the post 221. To perform arm curls, a weight lifter sits on the bench 14 in a direction facing the handle 194, with the arms supported on the inclined support 222. The weight lifter then grasps the handle 194 and bends the arms upwardly at the elbows.

It can now be appreciated that the pulley arrangement illustrated in FIG. 9 allows expedient mounting of a number of diverse attachments for performing a wide assortment of exercises.

Additionally, the upper support pulley 190 may be moved forwardly and rearwardly by movement of the vertical supports 26 and 28, as well as upwardly and downwardly by movement of the bar holders 46 and 48 attached to slidable weight supports 42 and 44. These multiple upper support pulley positions allow the weight lifter to adjust the initial lifting point. For example, a weight lifter positioned for a seated row may begin to lift the weights when the handle 194 attached to cable 191 is located above the feet or, by moving the upper support pulley forward, the weight lifter may begin the lift when the handle 194 attached to the cable 191 is above the knees.

Another advantage of the multiple upper support pulley positions is the ability to adjust the length of the lift. By moving upper support pulley 190 upward, the length of the lift can be increased while moving the upper support pulley 190 downwards the will decrease the length of the lift.

The ability to change the initial point of the lift and the length of the lift by moving upper support pulley 190 allows the weight lifter to concentrate development on specific muscles for a variety of exercises.

Having thus described a presently preferred embodiment of the present invention, it will now be appreciated that the objects of the invention have been fully achieved, and it will be understood by those skilled in the art that many changes in construction and circuitry and widely differing embodiments and applications of the invention will suggest themselves without departing from the spirit and scope of the present invention. The disclosures and the description herein are intended to be illustrative and are not in any sense limiting of the invention, more preferably defined in scope by the following claims.

What is claimed is:

1. Weight lifting apparatus for assisting a weight lifter in exercising, comprising:

a frame including a pair of spaced, substantially vertical members;

an elongated bench attached to said frame between said vertical members, said bench orientatable in a substantially horizontal position;

a pair of slide supports each disposed at a level above said bench in said horizontal position, one of said slide supports secured to each of said vertical members;

a pair of substantially parallel, substantially horizontally extending connecting members supported by said slide supports for selective reciprocal sliding adjustment in a substantially horizontal direction;

a pair of substantially vertical weight supports, one of said weight supports attached to each of said connecting members for positioning a weight bar at a plurality of positions over said bench; and said connecting members each disposed at a level above at least a portion of said bench in a horizontal orientation for preventing a weight bar from contacting and injuring a weight lifter on said bench.

2. The weight lifting apparatus of claim 1 further comprising chest support means for placing said bench in a near vertical position, said chest support means being slidably attached to said slide supports.

3. The weight lifting apparatus of claim 1 further comprising pectoral muscle exercise apparatus attached to said vertical weight supports.

4. The weight lifting apparatus of claim 1 further comprising dip bar means attached to said vertical weight supports.

5. The weight lifting apparatus of claim 1, wherein said slide supports comprise tubes.

6. The weight lifting apparatus of claim 5, wherein said connecting members are received at least partially within said tubes.

7. The weight lifting apparatus of claim 1, wherein a pair of slide supports are secured in vertically spaced relation to each of said vertical members.

8. The weight lifting apparatus of claim 7, wherein each slide support on each of said vertical members is juxtaposed with a slide support on the other of said vertical members.

9. The weight lifting apparatus of claim 1, further comprising:

a first pair of rings received on respective ones of said connecting members and extending substantially parallel therewith;

a second pair of rings substantially transversely secured on respective ones of said first pair of rings;

a support rod received through said second pair of rings;

said bench including pivotally connected seat and back portions; and means engageable with a portion of said bench and said support rod for supporting said bench in an inclined orientation.

10. The weight lifting apparatus of claim 9, further comprising:

a downwardly inclined bar on said frame;

a clamp member selectively positionable along said inclined bar, said clamp member including an open arcuate tab; and a support member pivotally secured to said seat portion of said bench, said support member including a horizontal bar dimensioned for engagement with said arcuate tab to secure said seat portion in a selected inclined orientation.

11. Weight lifting apparatus for assisting a weight lifter in exercising, comprising:

a frame including a pair of spaced, substantially vertical members;

an elongated bench attached to said frame between said vertical members;

hinge means for allowing said bench to fold into a Vshape having a back and a seat;

means for inclining both said back and said seat;

a pair of slide supports, one of said slide supports secured to each of said vertical members;

a pair of substantially parallel, substantially horizontally extending connecting members mounted for selective reciprocal sliding adjustment in a substantially horizontal direction;

a pair of substantially vertical weight supports, one of said weight supports attached to each of said connecting members for positioning a weight bar at a plurality of positions over said bench; and said connecting members each disposed at a level above at least a portion of said bench for preventing a weight bar from contacting and injuring a weight lifter on said bench.

12. The weight lifting apparatus of claim 11, further comprising a cable and pulley system selectively attachable to said weight lifting apparatus and including a weight disk secured to said cable.

13. The weight lifting apparatus of claim 12, further comprising means for vertically and laterally adjusting at least one pulley in said cable and pulley system to adjust the initial lifting point and length of lift in a variety of different exercises.

14. The weight lifting apparatus of claim 12, further comprising a retainer attachment for said frame including a horizontal plate and a pivotally connected vertical plate to allow performance of both standing and seated row exercises.

15. The weight lifting apparatus of claim 12, further comprising a leg curl attachment selectively mountable on said frame and operably associated with said cable and pulley system for performing leg exercises.

16. The weight lifting apparatus of claim 12, further comprising a vertical pulley attachment selectively mountable on said frame and operably associated with said cable and pulley system for performing upper body exercises.

17. The weight lifting apparatus of claim 12, further comprising an arm curl attachment selectively mountable on said frame and operably associated with said cable and pulley system for performing arm curl exercises.

* * * * *